United States Patent [19]

Stark

[11] Patent Number: 4,475,778

[45] Date of Patent: Oct. 9, 1984

[54] DRAWER SUSPENSION SYSTEM

[75] Inventor: Forest G. Stark, Jamestown, N.Y.

[73] Assignee: AVM Corporation, Jamestown, N.Y.

[21] Appl. No.: 370,453

[22] Filed: Apr. 21, 1982

[51] Int. Cl.[3] ..... A47B 88/10

[52] U.S. Cl. ..... 312/330 R; 312/333; 312/341 NR; 312/348

[58] Field of Search ..... 308/3.6, 3.8; 312/330 R, 333, 338, 341, 342, 348

[56] References Cited

U.S. PATENT DOCUMENTS

| | | | |
|---|---|---|---|
| 1,045,523 | 11/1912 | Cossey | 312/339 |
| 2,733,972 | 2/1956 | Diack | 312/341 R |
| 2,757,051 | 7/1956 | Wilmer et al. | 312/341 R |
| 3,386,784 | 6/1968 | Oppenhuizen et al. | 312/341 R |
| 3,451,730 | 6/1969 | Krispinsky et al. | 308/3.8 |
| 3,751,126 | 8/1973 | Hudson | 308/3.6 |
| 4,065,196 | 12/1977 | Stein | 312/341 R |
| 4,067,632 | 1/1978 | Sekerich | 312/341 R |
| 4,194,793 | 3/1980 | Offerman | 308/3.8 |

FOREIGN PATENT DOCUMENTS

| | | | |
|---|---|---|---|
| 2620002 | 11/1977 | Fed. Rep. of Germany | 312/330 R |

*Primary Examiner*—Victor N. Sakran
*Assistant Examiner*—Joseph Falk
*Attorney, Agent, or Firm*—Bean, Kauffman & Bean

[57] ABSTRACT

A drawer or storage unit suspension system having a pair of horizontally spaced, elongated case channels supported by the underside of an enclosure; a pair of drawer rails supported for linear movement by bearings located between the drawer rails and the case channels; an upright drawer support edge on each drawer rail and an open slot at the forward end of each upright for the gravity support of a drawer having side projecting flanges and side lugs resting, respectively, on the upright support edge and the open slot.

14 Claims, 11 Drawing Figures

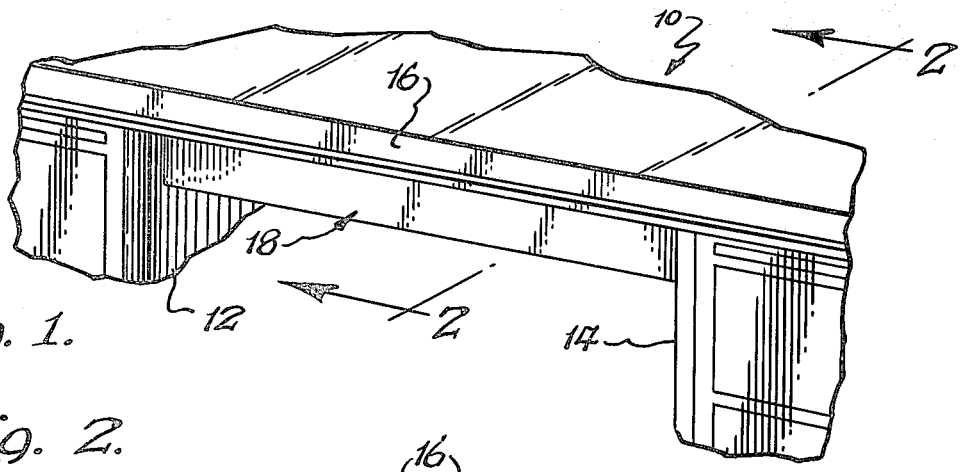
Fig. 1.
Fig. 2.
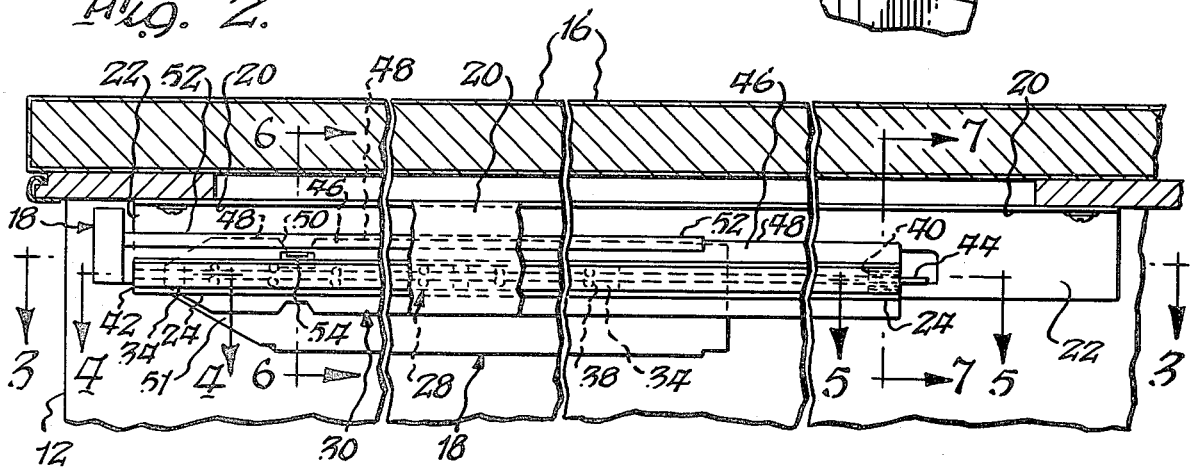
Fig. 3.
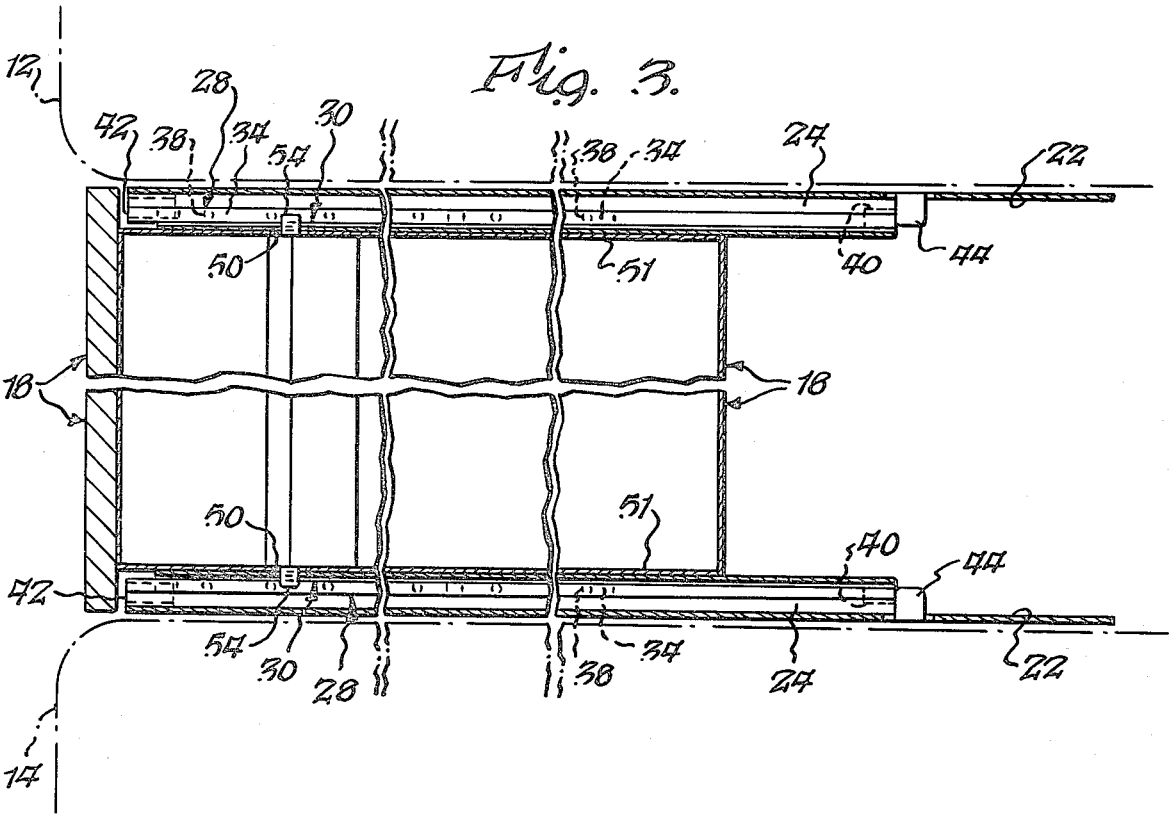

Fig. 4.
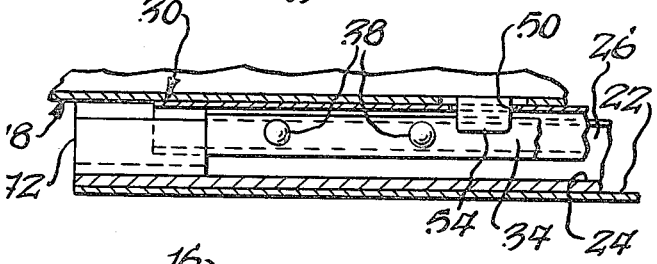
Fig. 5.
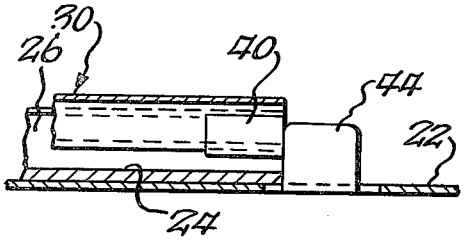
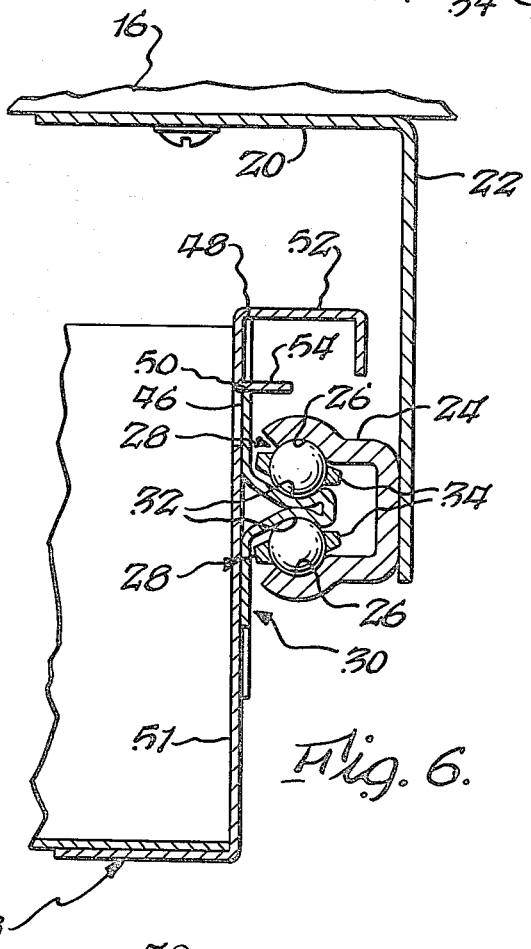
Fig. 6.
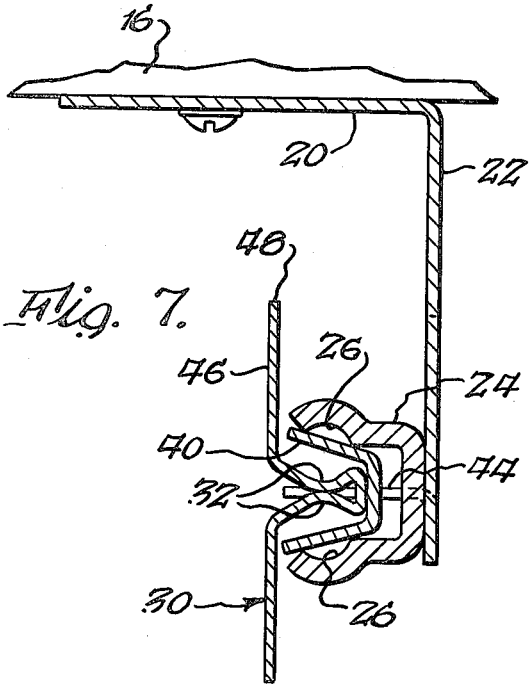
Fig. 7.
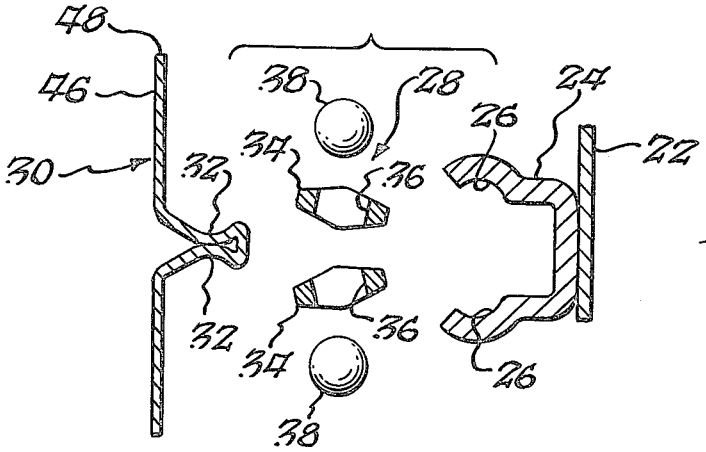
Fig. 8.

Fig. 9.
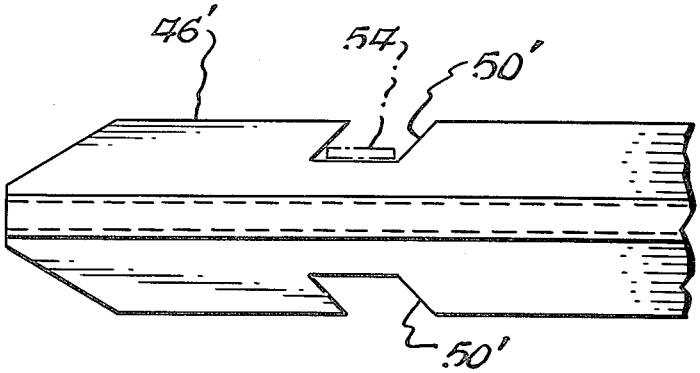
Fig. 10.
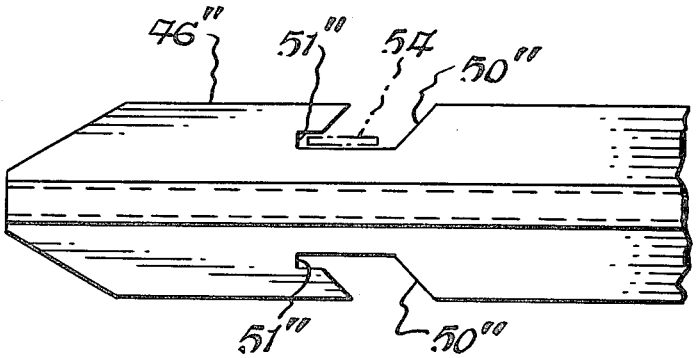
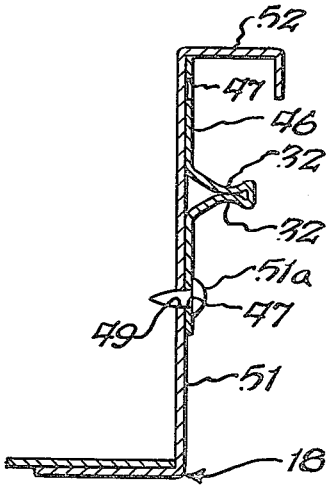
Fig. 11.

DRAWER SUSPENSION SYSTEM

BACKGROUND OF THE INVENTION

The present invention relates to desks or other similar enclosures and, more particularly, to a novel suspension and guiding system which permits drawers or other similar storage units to be easily and accurately moved from a closed position substantially within the enclosure to an open position of maximum extension therefrom.

Drawers for desks or cabinets have been mounted by a variety of different means ranging from simple friction slide arrangements to rather elaborate and complex roller and rail systems for handling heavily loaded drawers subject to frequent use. However, the friction slide arrangement is less than precise in its operation and the roller and rail arrangement is costly, complex and difficult to align and adjust. Moreover, in most prior art systems the drawer or storage unit has permanently affixed to each side face thereof the movable guide and support rail and, as a consequence, when the drawer is to be replaced or removed the guide and support rail must be similarly replaced and removed. This greatly increases repair and replacement costs and creates potential problems of alignment and fit for the replaced drawer within the enclosure.

SUMMARY OF THE INVENTION

In accordance with the teachings of the present invention, a storage unit or drawer suspension system is provided wherein the movable rails or channels and the stationary rails or channels may be part of a preassembled unit and installed independently of the drawer, and to which the drawer may be simply and quickly attached, removed and/or replaced. The arrangement is simple, relatively inexpensive to fabricate and install and is highly precise, smooth and accurate in operation. Moreover, the suspension assembly of the present invention is extremely compact to thereby minimize wasted space and/or maximize the storage capacity of the drawer.

More specifically, the suspension assembly includes two spaced sets of horizontally disposed elongated members, one member of each set being mounted for linear movement with respect to the other member of each set and is provided with support means to permit a storage unit to be gravity supported thereon and with means engageable with the storage unit for linear movement in response to movement of the storage unit towards one of its opened and closed extreme positions.

In the preferred embodiment of the invention each stationary member may include a case channel supported depthwise of the enclosure casing; each of the movable members may include a similarly disposed drawer rail supported within the case channel by suitable bearing assemblies; the support means may include an upper edge of each drawer rail extending depthwise of the enclosure casing to engage in gravity resting relation thereon a down-turned flange on opposite sides of the storage unit; and the means engageable with the storage unit may include a notch or open slot formed in the upper edge of each drawer rail, adjacent the forward end thereof to freely receive within the confines of the slot a tab projecting from opposite sides of the storage unit whereby forward movement of the storage unit causes the front of the tabs to engage their respective open slots for causing movement of the drawer rail in a forward or opening direction and rearward movement of the storage unit causes the rear of the tabs to engage their respective notches or open slots for causing movement of the drawer rail in a rearward or closing direction.

Alternatively, such means may include a fastening device operatively securing the drawer to the drawer rail on each side thereof as will become apparent hereinbelow.

BRIEF DESCRIPTION OF THE DRAWINGS

For a fuller understanding of the present invention reference should now be made to the following detailed description thereof taken in conjunction with the accompanying drawings, wherein:

FIG. 1 is a fragmentary pictorial view of a desk to which the suspension assembly of the present invention may be applied;

FIG. 2 is a fragmentary cross-sectional view taken substantially along line 2—2 of FIG. 1;

FIG. 3 is a fragmentary cross-sectional view taken substantially along line 3—3 of FIG. 2;

FIG. 4 is a fragmentary cross-sectional view taken substantially along line 4—4 of FIG. 2;

FIG. 5 is a fragmentary cross-sectional view taken substantially along line 5—5 of FIG. 2;

FIG. 6 is a fragmentary cross-sectional view taken substantially along line 6—6 of FIG. 2;

FIG. 7 is a fragmentary cross-sectional view taken substantially along line 7—7 of FIG. 2;

FIG. 8 is an exploded view, in section, of the details of the case channel, the bearing assembly and the drawer rail;

FIG. 9 is a simplified fragmentary view similar to FIG. 2 but showing an alternate drawer rail configuration;

FIG. 10 is a view similar to FIG. 9 but depicting a further form of drawer rail configuration; and FIG. 11 is a view similar to FIG. 6 but depicting a still further modified drawer rail configuration.

DETAILED DESCRIPTION OF THE PREFERRED EMBODIMENTS

Referring now to the drawings, the reference numeral 10 generally depicts a typical enclosure casing in the form of a desk having a left pedestal 12, a right pedestal 14, a desk top plate 16 and a central drawer or storage unit, generally depicted at 18. Although enclosure 10 will be referred to hereinbelow as a "desk" and the storage unit 18 as a "drawer", it is to be understood that these terms are used for ease in description and, therefore, are intended to include any type of enclosure having one or more linearly movable storage units.

In its assembled form the suspension system of the present invention includes a pair of spaced angle members 20, each secured to the undersurface of the desk top 16 of casing 10 adjacent its respective pedestal 12, 14 and running depthwise of the casing. The facing surfaces of the depending vertical legs 22 of each angle member 20 has suitably affixed (as by welds) adjacent the lower edge thereof case channels 24, which, similarly, run depthwise of the casing. As more clearly seen in FIGS. 6,7 and 8, each case channel 24 is provided with opposed, curved surfaces 26 that form longitudinal or linear raceways for a bearing assembly, generally depicted at 28. The opposite or coacting raceways are integrally formed on drawer rail members 30, which may be roll-formed out of flat plate stock to provide upper and lower curved raceway surfaces 32 that partially project within their respective case channels 24 in operative relation to the raceways 26 thereof.

The bearing assembly 28 includes, for each drawer rail 30 and case channel 24, a pair of longitudinally extending retainers 34, which may be fabricated of plastic, having a plurality of spaced round holes or openings 36 for the reception and retention of a like number of ball bearings 38. The arrangement is such that when the suspension unit is assembled each drawer rail 30 is fully supported by its respective case channel 24 and angle member 20 for smooth, linear movement with respect thereto. It should be noted, as seen in FIGS. 2 and 3, that the longitudinal or depthwise extent of each of the bearing retainers 34 is substantially less than the extent of case channels 24; the difference therebetween controlling the extent of forward travel of drawer rails 30 to their positions of maximum extension beyond enclosure casing 10. A suitable abutment element 40 may be provided at the rearward end of each drawer rail 30 in alignment with each of the retainers 34 and freely movable within the confines of case channel 24. Element 40 is adapted to engage the bearing assembly 28 and move the same into abutting engagement with a stop 42 fixed to the forward end of each case channel 24 to limit the forward travel of the drawer rails 30. Similarly, a stop tab 44, which may be drawn out of each angle member leg 22, may be provided in alignment with drawer rail 30 to limit the rearward travel thereof. Although stops 40 and 42 have been depicted as separate elements suitably secured to drawer rails 30 and case channels 24, respectively, it is to be understood that these could be formed integral therewith such as, for example, by shear tabs.

Means are provided on each drawer rail 30 to coact with the drawer 18 to horizontally support the same and to permit movement of the drawer to cause extension or retraction of the drawer rail. For this purpose, each drawer rail 30 is provided with an integrally formed, longitudinally extending and forwardly tapered upright 46 terminating in an upper support edge 48 (FIGS. 2,6 and 7). Adjacent its forward tapered end, drawer rail upright 46 is notched or open slotted at 50. Each upper sidewall 51 of drawer 18 is provided with a longitudinally extending down-turned flange 52 that is adapted to gravity rest upon its respective drawer rail support edge 48 and is further provided with a projecting lug or tab 54 that is adapted to be received in operative relation within the confines of its respective drawer rail notch 50. It should, thus, be apparent that drawer 18 is fully, but removably, supported by drawer rails 30 and will cause the same to extend or retract by engagement between lugs 54 and forward or rearward portions, respectively, of notches 50.

The installation and assembly of the suspension system of the present invention is simple, accurate, quick and efficient. Firstly, the case channels 24 are affixed to the angle member 20. Then, the drawer rails 30 and the bearing assemblies 28 are combined in operative relation within the case channels 24. The stops 42 and 44 may then be bent up to fix the position of the suspension assembly and to confine the bearing assemblies. The angle member 20 may then be attached to the undersurface of the desk top plate 16. The final step is that of simply resting the drawer 18 on drawer rail edge 48 and engaging lug 54 into notch 50. To remove the drawer, the same need only be lifted off drawer rail edge 48 in the extended position thereof.

It has been found that certain modifications to the configuration of the notch or open slot 50 in upright 46 will serve to prevent accidental, inadvertent or unintended disengagement of the drawer tab 54 therefrom, especially when in its position of maximum extension.

Thus, as depicted in FIG. 9, the slot 50' may have substantially parallel tab abutting edges that are directed generally downwardly and forwardly from the upper edge of upright 46 such that tab 54 (confined therebetween) will abut against the forward leading slot edge in response to vertically upward movement of the drawer. In this manner, the drawer and its tab 54 will be positively prevented from disengagement with the suspension system upright 46'. However, intended disengagements can still be easily accomplished by a slight upward and tilting movement of the drawer tab 54 with respect to the upright 46'.

FIG. 10 is similar to FIG. 9, but depicts a means for a more positive locking of the drawer tab 54 within the slot 50''. To this end, the bottom of slot 50'' is provided with forwardly projecting short slot 51'' which is adapted to receive the forward edge of tab 54 to thereby restrain the same and the drawer from inadvertent disengagement with upright 46''. However, intended disengagements can still be easily initiated by a slight horizontal or rearward movement of the drawer and its tab 54 with respect to slot 50'' and completed in the manner as described with respect to FIG. 9.

A still further modification is depicted in FIG. 11 wherein suitable fastening means may be provided to positively secure the drawer from inadvertent disengagement from the suspension system. To this end, the upright 46 and the drawer 18 may be provided with openings 47 and 49, respectively, for reception of a screw device **51*a* whereby the drawer is locked from accidental disengagements. In this form of the invention, the drawer tabs and drawer rail notches or slots would be eliminated as illustrated. An upper opening 47** may be provided as a manufacturing expedient to permit both left hand and right hand use of the drawer rail.

Although preferred embodiments of the invention have been disclosed and described, changes will obviously occur to those skilled in the art, without departing from the spirit thereof. It is, therefore, intended that the present invention is to be limited only by the scope of the appended claims.

What is claimed is:

1. A drawer suspension assembly, comprising:

two spaced sets of horizontally disposed elongated rails and channels, wherein each of said sets has its rail at least partially projecting into its channel;

a linear bearing assembly for mounting and supporting one of said rail and said channel of each of said sets for linear movement with respect to the other of said rail and channel of each of said sets, said bearing assembly engaging with a pair of races formed one race as part of said rail and the other race as part of said channel of each of said sets;

a constraining means for constraining the other of said rail and said channel of each of said sets against movement;

a support means on said one of said rail and said channel of each of said sets to permit a storage unit having flanges and lugs projecting laterally from opposite sidewalls thereof to be gravity supported thereon, said support means comprising a longitudinally extending upright extending upwardly from said one of said rail and said channel and terminating in an upper support edge for coaction with one of said flanges;

engageable means on said one of said rail and said channel of each of said sets for engaging with said storage unit, whereby movement of said storage unit towards opened and closed positions thereof causes corresponding movement of said one of said rail and said channel of each of said sets, and said engageable means includes an open slot in said upright for coaction with one of said lugs.

2. The assembly according to claim 1, wherein:

said open slot is located adjacent the forward end of said upright at said upper support edge.

3. The assembly according to claim 2, wherein:

said open slot includes a forward edge that is inclined downwardly and forwardly of said upper support edge to prevent unintended disengagement of said one of said lugs from said upright.

4. The assembly according to claim 3, wherein:

said open slot further includes a short slot projecting forwardly from a lower portion of said forward edge.

5. The assembly according to claim 2, wherein:

said constraining means includes a longitudinally extending angle member having an upper horizontal leg for attachment to an undersurface of an enclosure casing for said storage unit and a lower vertical leg secured to said other of said rail and said channel of each of said sets.

6. The assembly according to claim 5, wherein:

said other of said rail and said channel is said channel; and there is further provided a stop extending from said lower leg and located at the rearward end of said channel in alignment with said rail of each of said sets to limit the rearward travel thereof.

7. The assembly according to claim 6, further comprising:

an abutment located at the rearward end of each of said rails and movable therewith within said channels of each of said sets for abutting engagement with a rearward end of said bearing assembly thereof; and a stop located at a forward end of each of said channels for abutting engagement with said bearing assembly thereof to limit the forward travel of said rails.

8. The assembly according to claim 7, further comprising:

a second linear bearing assembly located below said first mentioned bearing assembly and engageable with races formed as integral parts of each of said rails and each of said channels.

9. The assembly according to claim 8, wherein:

said bearing assembly and said second bearing assembly include ball bearings located and maintained in spaced relation by longitudinal retainers between said races formed by said rails and said channels.

10. The assemby according to claim 9, wherein:

said storage unit has flanges and lugs projecting laterally from opposite sidewalls thereof;

said support means includes upper support edges for coaction with one of said flanges; and said engageable means includes open slot for coaction with one of said lugs.

11. The assembly according to claim 10, wherein:

said open slot includes a forward edge that is inclined downwardly and forwardly of said upper support edge; and one of said lugs is confined against unintended disengagements from said open slot by said forward edge.

12. The assembly according to claim 11, wherein:

said open slot further includes a short slot projecting forwardly from a lower portion of said forward edge; and said one of said lugs at least partially projects into and is confined by said short slot.

13. The assembly according to claim 1, wherein:

said engageable means further includes a fastener securing said sidewalls to said upright of each said rail.

14. A drawer suspension assembly, comprising:

two spaced sets of horizontally disposed elongated rails and channels, wherein each of said sets has its rail at least partially projecting into its channel, each of said channels having upper and lower curved surfaces arranged in a spaced, facing relationship, each of said rails having upper and lower curved surfaces, said upper and lower curved surfaces of said rail are arranged in spaced facing relation to said upper and lower curved surfaces of said channel of each of said sets;

a linear bearing assembly for mounting and supporting one of said rail and said channel of each of said sets for linear movement with respect to the other of said rail and said channel of each of said sets, said bearing assembly including a plurality of ball bearings located between said upper curved surfaces of said rail and channel and maintained in spaced relationship by an elongated retainer and a further plurality of ball bearings located between said lower curved surfaces of said rail and said channel and maintained in spaced relation by aa further elongated retainer;

a constraining means for constraining the other of said rail and said channel of each of said sets against movement;

support means on said one of said rail and said channel of each of said sets to permit a storage unit to be gravity supported thereon;

engageable means on said one of said rail and said channel of each of said sets for engaging with said storage unit, whereby movement of said storage unit towards open and closed positions thereof causes corresponding movement of said one of said rail and said channel of each of said sets;

a stop located at at a forward end of said other of said rail and said channel in alignment with said bearing assembly to limit forward travel thereof; and a further stop located at a rearward end of said one of said rail and said channel in alignment with said bearing assembly, whereby forward movement of said one of said rail and said channel is limited by abutting engagement of said bearing assembly with said stop and said further stop.

* * * * *